US007486260B2

(12) United States Patent
Lee

(10) Patent No.: US 7,486,260 B2
(45) Date of Patent: Feb. 3, 2009

(54) PLASMA DISPLAY PANEL HAVING A DRIVING APPARATUS AND METHOD FOR DISPLAYING PICTURES

(75) Inventor: Soo-Jin Lee, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 691 days.

(21) Appl. No.: 10/980,687

(22) Filed: Nov. 3, 2004

(65) Prior Publication Data

US 2005/0104813 A1 May 19, 2005

(30) Foreign Application Priority Data

Nov. 19, 2003 (KR) ..... 10-2003-0082231

(51) Int. Cl.
*G09G 3/28* (2006.01)

(52) U.S. Cl. ..... 345/63; 345/60; 345/89; 345/37; 345/41

(58) Field of Classification Search ..... 345/63, 345/60, 89, 37, 41
See application file for complete search history.

(56) References Cited

U.S. PATENT DOCUMENTS

| | | | | |
|---|---|---|---|---|
| 6,388,645 | B2 * | 5/2002 | Kasahara et al. | 345/63 |
| 6,414,657 | B1 | 7/2002 | Kasahara et al. | |
| 6,542,135 | B1 | 4/2003 | Kasahara et al. | |
| 7,167,146 | B2 * | 1/2007 | Kang | 345/68 |
| 2003/0218581 | A1 * | 11/2003 | Kawanami et al. | 345/60 |

FOREIGN PATENT DOCUMENTS

| | | | |
|---|---|---|---|
| CN | 1246951 | A | 3/2000 |
| CN | 1290386 | A | 4/2001 |
| EP | 1 156 468 | A1 | 11/2001 |
| EP | 1 187 089 | A2 | 3/2002 |
| EP | 1 271 461 | A2 | 1/2003 |
| JP | 10-177364 | | 6/1998 |
| JP | 11-65519 | | 3/1999 |
| JP | 11-65520 | | 3/1999 |

(Continued)

OTHER PUBLICATIONS

Patent Abstracts of Japan, Publication No. 10-177364, dated Jun. 30, 1998, in the name of Shigehiro et al.

(Continued)

*Primary Examiner*—Richard Hjerpe
*Assistant Examiner*—Leonid Shapiro
(74) *Attorney, Agent, or Firm*—Christie, Parker & Hale, LLP

(57) ABSTRACT

A driving apparatus of a plasma display panel (PDP) and a method for displaying pictures on the plasma display panel, which are capable of increasing the ability to express a low gray scale. Common non-emitted sub-fields are detected, using picture signal data having the maximum level of the gray scale, of all input picture signal data within one frame of the input picture signal data. Sub-fields having higher weights are divided into a plurality of sub-fields having lower weights and the plurality of sub-fields having lower weights are rearranged as sub-fields for expression of gray scale, corresponding to the number of non-emitted sub-fields. In addition, the number of sustains corresponding to the rearranged sub-fields are generated.

18 Claims, 7 Drawing Sheets

FOREIGN PATENT DOCUMENTS

| | | |
|---|---|---|
| JP | 11-119730 | 4/1999 |
| JP | 2000-172225 | 6/2000 |
| JP | 2003-15587 | 1/2003 |
| KR | 2002-0014766 | 2/2002 |

OTHER PUBLICATIONS

Patent Abstracts of Japan, Publication No. 11-065519, dated Mar. 9, 1999, in the name of Shigehiro et al.

Patent Abstracts of Japan, Publication No. 11-065520, dated Mar. 9, 1999, in the name of Shigehiro et al.

Patent Abstracts of Japan, Publication No. 2000-172225, dated Jun. 23, 2000, in the name of Yasuhi Yoneda.

Patent Abstracts of Japan, Publication No. 2003-015587, dated Jan. 17, 2003, in the name of Katsuhiko Morita.

* cited by examiner

PLASMA DISPLAY PANEL HAVING A DRIVING APPARATUS AND METHOD FOR DISPLAYING PICTURES

CROSS REFERENCE TO RELATED APPLICATION

This application claims priority to and the benefit of Korean Patent Application No. 10-2003-0082231 filed on Nov. 19, 2003, in the Korean Intellectual Property Office, the contents of which is incorporated herein by reference.

BACKGROUND OF THE INVENTION (a) Field of the Invention

The present invention relates to a driving apparatus of a plasma display panel (PDP) and a method for displaying pictures on the plasma display panel, and more particularly, to a driving apparatus of a plasma display panel (PDP) and a method for displaying pictures on the plasma display panel which are capable of reducing pseudo contour.

(b) Description of the Related Art

Recently, flat panel displays, such as liquid crystal displays (LCDs), field emission displays (FEDs) and PDPs, have been actively developed. The PDPs are being preferred over the other flat panel displays with regard to their high luminance, high luminous efficiency and wide viewing angle. Accordingly, the PDPs are being highlighted as a substitute for conventional cathode ray tubes (CRTs) for large-screen displays of more than 40 inches.

The PDPs are flat panel displays that use plasma generated by gas discharge to display characters or images. The PDPs include, according to their size, more than several tens to millions of pixels arranged in the form of a matrix. These PDPs are classified into a direct current (DC) type and an alternating current (AC) type according to patterns of waveforms of driving voltages applied thereto and discharge cell structures thereof.

The DC PDP has electrodes exposed to a discharge space, thereby causing current to directly flow through the discharge space during application of a voltage to the DC PDP. In this connection, the DC PDP has a disadvantage in that it requires a resistor for limiting the current. On the other hand, the AC PDP has electrodes covered with a dielectric layer that naturally forms a capacitance component to limit the current and protects the electrodes from the impact of ions during discharge. As a result, the AC PDP is considered superior to the DC PDP with regard to a long lifetime.

FIG. 1 is a perspective view illustrating a part of an AC PDP. Scan electrodes 4 and sustain electrodes 5 covered with dielectric layer 2 and protective layer 3 are arranged in pairs in parallel on first glass substrate 1. A plurality of address electrodes 8 covered with insulation layer 7 is arranged on second glass substrate 6. Barrier ribs 9 are formed in parallel with address electrodes 8 on insulation layer 7 such that each barrier rib 9 is interposed between adjacent address electrodes 8. Phosphor 10 is coated on the surface of insulation layer 7 and on both sides of each partition wall 9. First and second glass substrates 1, 6 are arranged to face each other while defining discharge space 11 therebetween so that address electrodes 8 are orthogonal to scan electrodes 4 and sustain electrodes 5. In the discharge space, discharge cell 12 is formed at an intersection between each address electrode 8 and each pair of scan electrodes 4 and sustain electrodes 5.

FIG. 2 shows an arrangement of the electrodes in the PDP. The electrodes of the PDP are arranged in the form of an m×n matrix. m address electrodes A1 to Am are arranged in a column direction. n scan electrodes Y1 to Yn and n sustain electrodes X1 to Xn are alternately arranged in a row direction. Discharge cell 12 shown in FIG. 2 corresponds to discharge cell 12 shown in FIG. 1.

In general, a process for driving the AC PDP can be expressed by temporal operation periods, i.e., a reset period, an address period and a sustain period. The reset period is a period wherein the state of each cell is initialized such that an addressing operation of each cell is smoothly performed. The address period is a period wherein an address voltage is applied to an (addressed) cell to accumulate wall charges on the addressed cell to in order to select a cell to be turned on and a cell not to be turned on in the PDP. The sustain period is a period wherein sustain pulses are applied to the addressed cell, thereby performing a discharge according to which a picture is actually displayed.

As shown in FIG. 3, in the PDP, a gray scale is expressed by dividing one frame (1 TV frame) into a plurality of sub-fields and performing a time-division operation for the plurality of sub-fields. Each sub-field includes the reset period, the address period and the sustain period. FIG. 3 illustrates one frame divided into 8 sub-fields in order to express 256 levels of gray scale. As shown in the figure, each sub-field SF1-SF8 includes reset periods (not shown), address periods Ad1-Ad8 and sustain periods S1-S8. sustain periods S1-S8 have emission periods 1T, 2T, 4T, . . . , 128T of the ratio of 1:2:4:8:16:32:64:128.

For example, a level 3 of gray scale is expressed by discharging a discharge cell during a sub-field having an emission period of 1T and a sub-field having an emission period of 3T so as to have a total emission period of 3T. In this way, a combination of different sub-fields having different emission periods produce pictures of 256 levels of gray scale.

When input data of one frame of a picture input signal consists of 8 bits, it has values within a range of 0 to 255. Accordingly, input data having values of 127, 63, 31, 15, 7, 3, and 1 use only 7 (emitted in sub-fields SF1 to SF7), 6, 5, 4, 3, 2 bits and 1 bit, respectively. Remaining (non-used) bits are filled with "0" (i.e., not emitted in remaining sub-fields). Corresponding picture information is displayed depending on the number of sustain pulses defined by a level of automatic power control (APC). In other words, the picture information always uses all 8 bits irrespective of values of the picture information, that is, eight sub-fields are all operated. Also, in the case that a maximal value is small, high-order bits are merely filled with '0'.

When a moving picture is displayed according to the sub-field arrangement as shown in FIG. 3, pseudo contour is generated due to human visual properties. FIG. 4 is a diagram illustrating one example of the generation of the pseudo contour. If the moving picture having a level 127 of gray scale and a level 128 of gray scale in parallel moves to the right at a fixed speed, the pseudo contour may be exhibited as shown in FIG. 4 according to the sub-field arrangement shown in FIG. 3. According to a property that human vision catches up with the movement of the picture, the gray scale is perceived in an arrow direction as shown in FIG. 4. Accordingly, pseudo contour, such as a level 255 of gray scale, is generated between the level 127 of gray scale and the level 128 of gray scale.

SUMMARY OF THE INVENTION

In accordance with the present invention a driving apparatus of a plasma display panel and a method for displaying pictures on the plasma display panel, which are capable of reducing pseudo contour of the pictures using non-emitted sub-fields, are provided.

In accordance with one aspect, the present invention provides a driving apparatus of a plasma display panel, including:

a peak detector for detecting common non-emitted sub-fields through picture signal data having the maximum level of the gray scale of all input picture signal data within one frame and transmitting information of the non-emitted sub-fields;

a sub-field generator for dividing sub-fields having higher weights into a plurality of sub-fields having lower weights and rearranging the plurality of sub-fields having lower weights as sub-fields for expression of gray scale when the non-emitted sub-fields are detected by the peak detector; and a sustain number generator for generating the number of sub-fields corresponding to the plurality of sub-fields rearranged when the non-emitted sub-fields are detected by the peak detector.

Weight differences between the plurality of sub-fields rearranged by the sub-field generator may be gradually decreased as the weight becomes higher.

In accordance with another aspect, the present invention provides a method for displaying a picture on a plasma display panel, the method including dividing a picture of each frame to be displayed on the plasma display panel into a plurality of sub-fields, corresponding to input picture signal data, and combining brightness weights of the plurality of sub-fields for expressing gray scales, the method including:

(a) detecting common non-emitted sub-fields through picture signal data having the maximum level of the gray scale of all input picture signal data within one frame of the input picture signal data;

(b) dividing sub-fields having higher weights into a plurality of sub-fields having lower weights and rearranging the plurality of sub-fields having lower weights as sub-fields for expression of gray scale when the non-emitted sub-fields are detected in step (a); and (c) generating the number of sub-fields corresponding to the plurality of sub-fields rearranged when the non-emitted sub-fields are detected in step (a).

Weight differences between the plurality of sub-fields rearranged in step (b) may be gradually decreased as the weight becomes higher.

DETAILED DESCRIPTION

Figure 1:
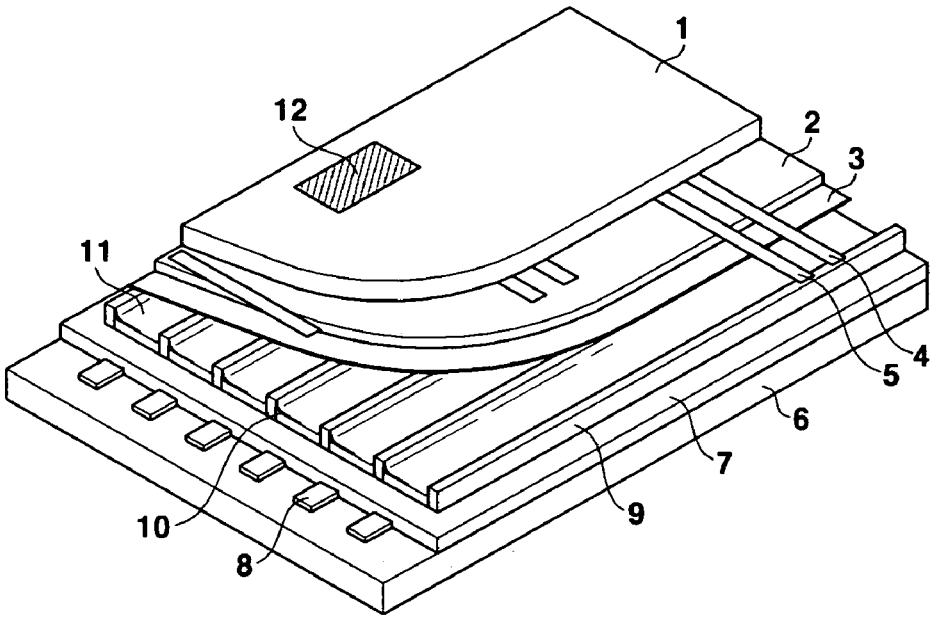
FIG.1 (Prior Art)
FIG. 1 is a perspective view illustrating part of an AC PDP.
Figure 2:
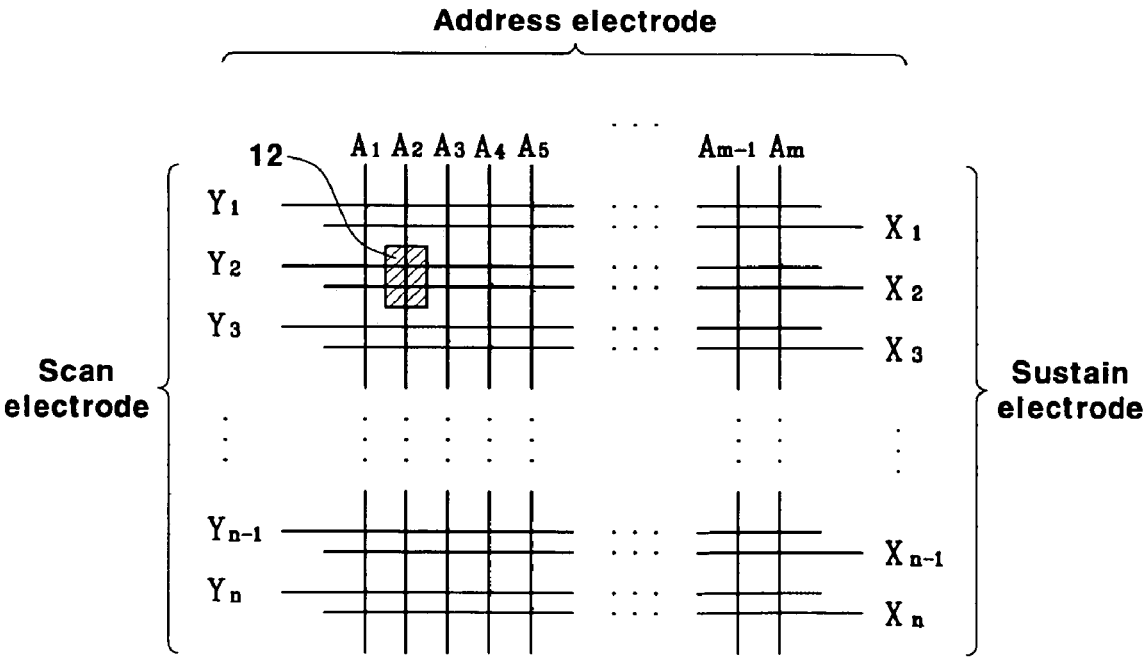
FIG.2 (Prior Art)
FIG. 2 is a schematic view illustrating an arrangement of electrodes in the PDP.
Figure 3:
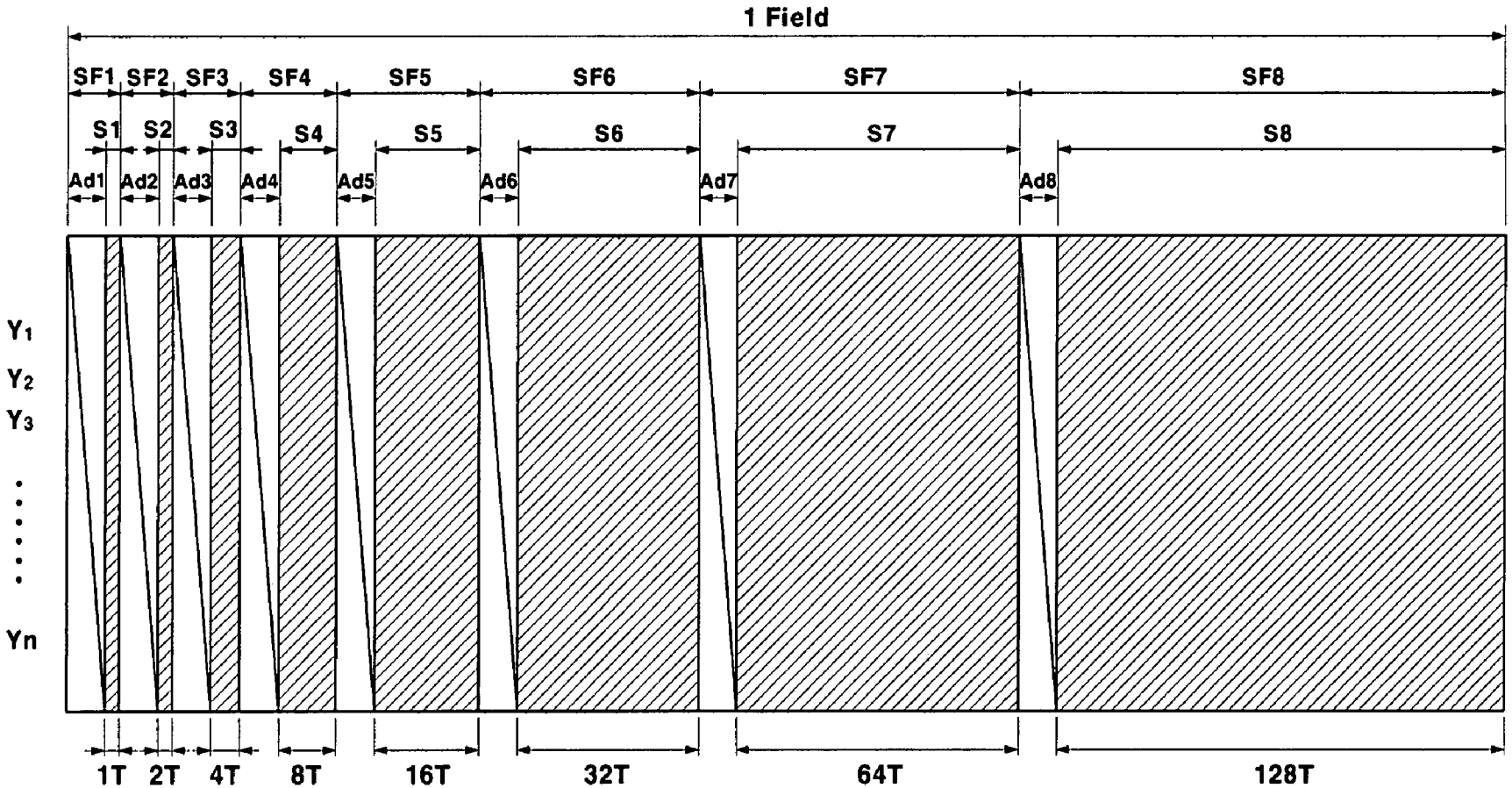
FIG.3 (Prior Art)
FIG. 3 is a diagram illustrating a method for expressing a gray scale in the plasma display panel.
Figure 4:
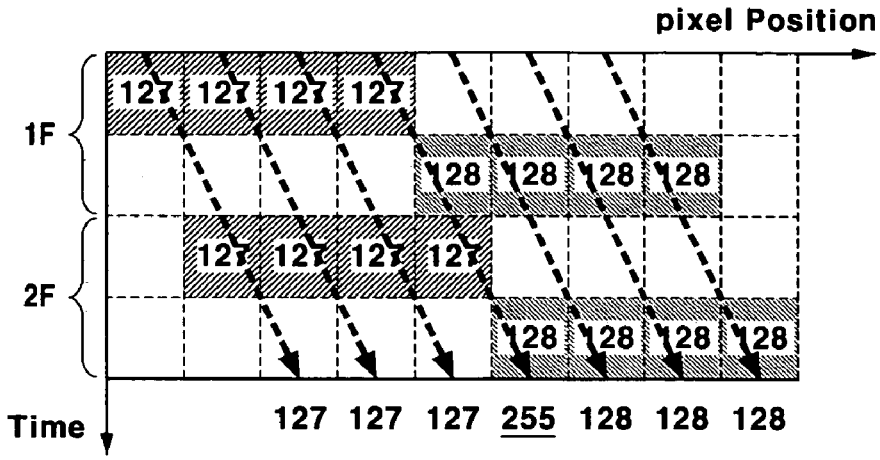
FIG.4 (Prior Art)
FIG. 4 is a diagram illustrating one example of generation of pseudo contour.
Figure 5:
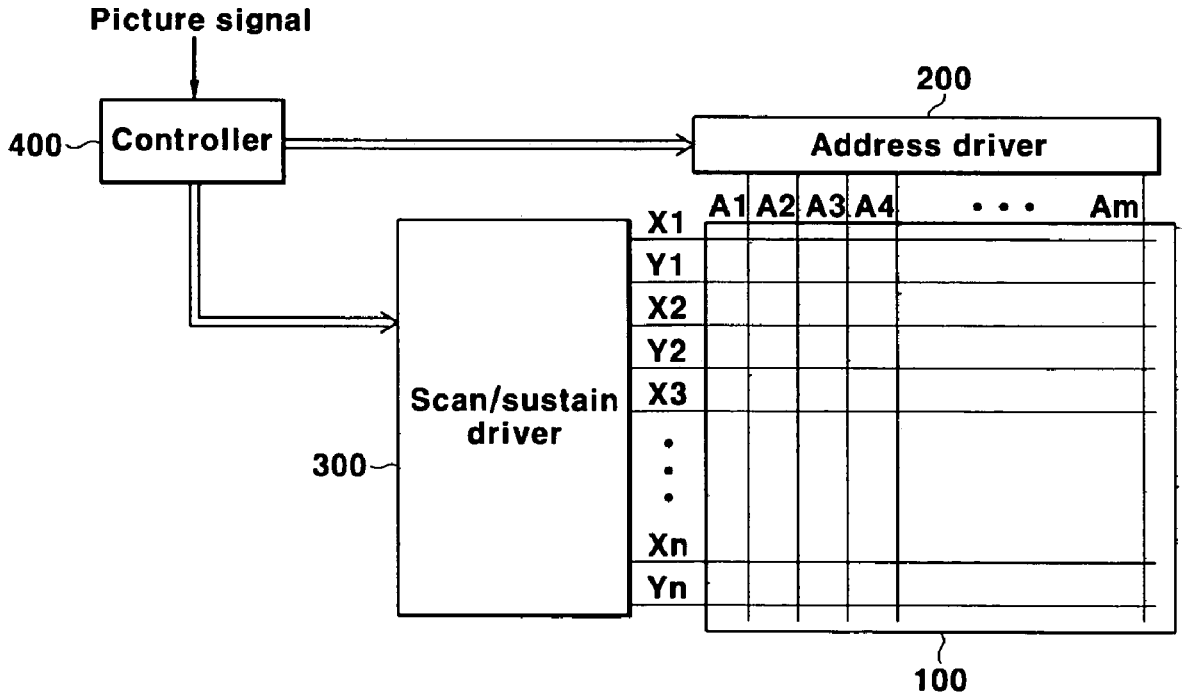
FIG. 5 is a block diagram of a plasma display panel according to an embodiment of the present invention.

Referring now to FIG. 5, a PDP according to an exemplary embodiment of the present invention includes plasma panel 100, address driver 200, scan and sustain driver 300, and controller 400.

Plasma panel 100 includes a plurality of address electrodes A1 to Am arranged in a column direction, and a plurality of scan electrodes Y1 to Yn and a plurality of sustain electrodes X1 to X2*n* alternately arranged in a row direction. Address driver 200 receives an address driving control signal from controller 400, and applies display data signals to respective address electrodes A1 to Am for selecting desired discharge cells. Scan and sustain driver 300 receives a control signal from controller 400, and alternately applies sustain pulse voltages to scan electrodes Y1 to Yn and sustain electrodes X1 to X2*n*, respectively, thereby causing selected discharge cells to perform a sustain discharge.

Controller 400 externally receives image (picture) signals, such as a red, green, blue (RGB) image signal and a synchronization signal, divides one frame of the RGB image signal into a plurality of sub-fields, and divides each sub-field into a reset period, an address period and a sustain period for driving the PDP. Controller 400 then supplies address driver 200 and scan and sustain driver 300 with a required control signal by adjusting the number of sustain pulses to be applied during each sustain period of each sub-field within one frame.

Figure 6:
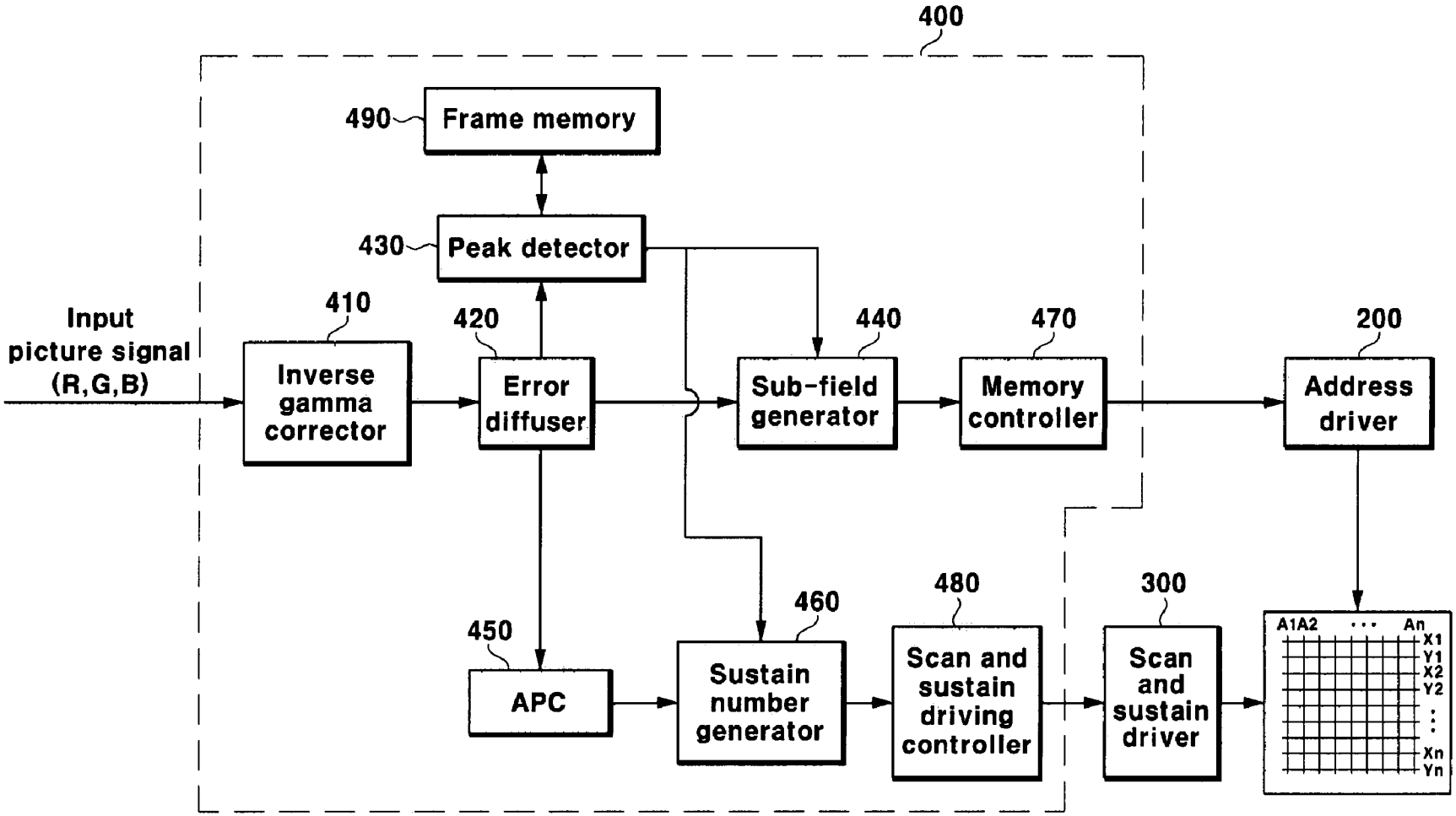
FIG. 6 is a block diagram of a controller of the plasma display panel according to the embodiment of the present invention.

Controller 400 according to the embodiment of the present invention will be described in more detail with reference to FIGS. 6 to 9. As shown in FIG. 6, controller 400 of the PDP includes inverse gamma corrector 410, error diffuser 420, peak detector 430, sub-field generator 440, APC 450, sustain number generator 460, memory controller 470, sustain and scan driving controller 480, and frame memory 490.

Inverse gamma corrector 410 corrects the RGB picture input data of n bits, which is being currently input, into a picture signal of m bits ($m \geqq n$) by mapping the RGB picture input data on a inverse gamma curve. In general PDPs, n is 8 and m is 10 or 12.

As the picture signal input to inverse gamma corrector 410 is a digital picture signal, if an analog picture signal is input to the PDP, it is necessary to convert the analog picture signal into a digital picture signal by means of an analog to digital converter (not shown). In addition, inverse gamma corrector 410 can include a look-up table (not shown) for storing data corresponding to the inverse gamma curve for mapping the picture signal or a logic circuit (not shown) for generating data corresponding to the inverse gamma curve through a logical operation.

Error diffuser 420 error-diffuses a picture of low-order m−n bits of m bits, which are inverse gamma-corrected and expanded by inverse gamma corrector 410, throughout adjacent pixels. The error diffusion is a method for displaying a picture of low-order bits by separating the picture of low-order bits to be error-diffused and diffusing the separated picture throughout adjacent pixels, which is described in detail in Korean Patent Laid-Open Publication No. 2002-0014766.

Peak detector 430 extracts a peak value (meaning the maximum input level of gray scale) from all picture input data of one frame which is being currently input, and then, when the peak value is expressed by sub-fields, detects whether non-emitted sub-fields of sub-fields having the maximum weight are present or not. When the peak value is expressed by sub-fields, the number of non-emitted sub-fields of sub-fields having the maximum weight is the same in all input picture signal data within one frame. As shown in FIG. 6, using data obtained after input data of one frame, which is being currently input, is processed by inverse gamma corrector 410 and error diffuser 420 peak detector 430, peak detector 430 detects whether the non-emitted sub-fields (sub-fields not used for expression of gray scale) of the sub-fields having the maximum weight are present or not. This is because the data obtained through the inverse gamma correction and the error diffusion is the most similar to data to be displayed on the PDP. However, in some cases, peak detector 430 can use the input data before the inverse gamma correction or the input data after the inverse gamma correction to extract peak values of all input data within one frame and detect whether the non-emitted sub-fields of the sub-fields having the maximum weight are present or not.

The peak value is obtained by delaying the picture input data by one frame. Frame memory 490 can be used to obtain such a delay, which is apparent to those skilled in the art.

Figure 7A:
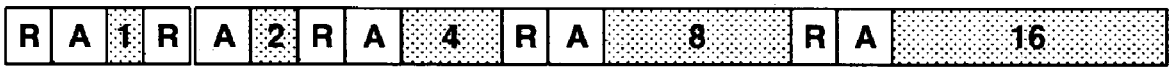
FIGS. 7A and 7B are diagrams illustrating the number of non-emitted sub-fields according to a level of gray scale of an input picture signal if the number of used sub-fields is 5.
Figure 7B:
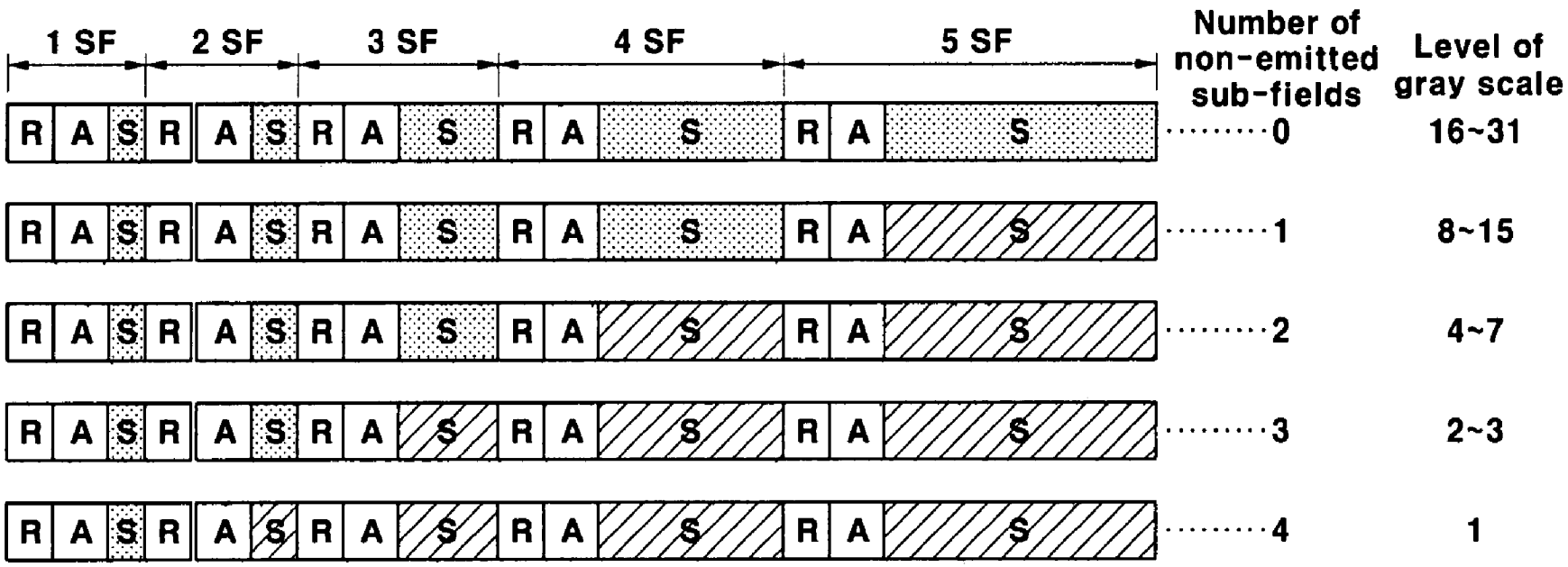

FIGS. 7A and 7B are diagrams illustrating the number of non-emitted sub-fields according to a level of gray scale of an input picture signal if the number of used sub-fields is 5. 'R', 'A' and 'S' denote a reset portion, an address portion and a sustain portion', respectively.

Herein, although a 32 level of gray scale using 5 sub-fields is exemplified in FIGS. 7A and 7B for the sake of convenience, the number of non-emitted sub-fields required for expression of a higher level, e.g., 128, of gray scale can be obtained through the same method.

FIG. 7A is a diagram illustrating the arrangement of sub-fields and weight of each sub-field at a 32 level of gray scale. FIG. 7B is a diagram illustrating the number of non-emitted sub-fields according to a level of gray scale of an input picture signal in the arrangement of sub-fields as shown in FIG. 7A.

As shown in FIG. 7B, since all of sub-fields 1SF to 5SF having respective maximum weights of 1 to 16 are turned on in 16 to 31 levels of gray scale, there is no non-emitted sub-field. Also, only sub-field 5SF (shown by an oblique line) having the maximum weight of 16 is present as the non-emitted sub-field of the sub-fields having the respective maximum weights in 8 to 15 levels of gray scale. In other words, the sub-field having weight of 16 is not used to express the 8 to 15 levels of gray scale. In this way, two non-emitted sub-fields are present in 4 to 7 levels of gray scale, three non-emitted sub-fields are present in 2 and 3 levels of gray scale, and four non-emitted sub-fields are present in an 1 level of gray scale.

Through such a method shown in FIGS. 7A and 7B, peak detector 430 obtains the number of non-emitted sub-fields from sub-fields whose maximum weights are common to all picture signal data within one frame, using the peak value (maximum input level of gray scale) of the input picture signal. Peak detector 430 then transmits information of the number of non-emitted sub-fields obtained to sub-field generator 440 and sustain number generator 460.

Sub-field generator 440 rearranges the non-emitted sub-fields into an arrangement of sub-fields for reducing pseudo contour, using the information of the number of non-emitted sub-fields received from peak detector 430. The non-emitted sub-fields are added as sub-fields for expression of gray scale in such a manner that the non-emitted sub-fields are rearranged as an arrangement of sub-fields where a weight difference between one sub-field and another sub-field is further reduced in sub-fields having higher weights.

Figure 8A:
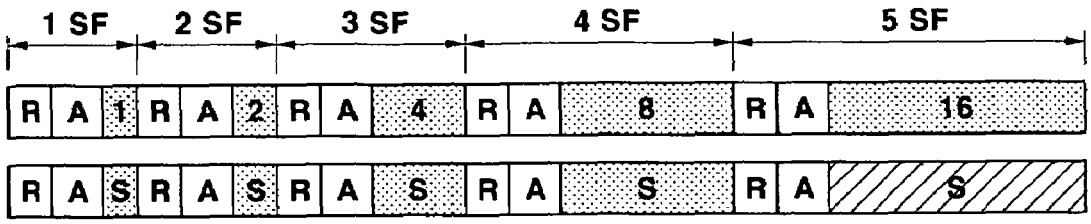
FIGS. 8A and 8B are diagrams illustrating the arrangement of sub-fields rearranged by the sub-field generator.
Figure 8B:
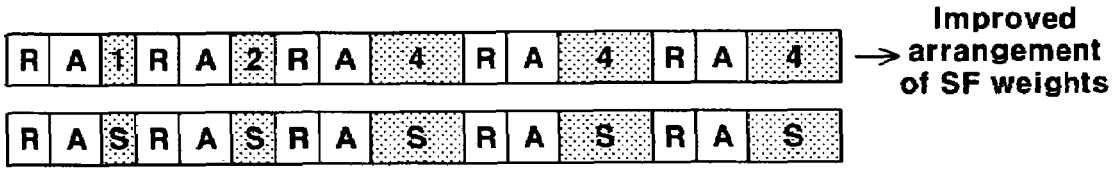

A method of rearranging the sub-fields in sub-field generator 440 will now be described in detail. FIGS. 8A and 8B are diagrams illustrating the arrangement of sub-fields rearranged in sub-field generator 440. Again, 'R', 'A' and 'S' denote a reset portion, an address portion and a sustain portion', respectively.

FIG. 8A shows a non-emitted sub-field (a sub-field having weight of 16) when the level of gray scale of an input picture signal is 8 to 15 in a conventional arrangement of sub-fields. FIG. 8B shows the arrangement of sub-fields rearranged in sub-field generator 440 for the arrangement shown in FIG. 8A.

When the level of gray scale of the input picture signal data within one frame is 8 to 15, the sub-field having weight of 16 is not emitted and not used to express the gray scale. Accordingly, sub-field generator 440 can rearrange the sub-fields, as shown in FIG. 8B, so as to express the gray scale of the input picture signal data. In more detail, by dispersing sub-field 4SF having weight of 8 into a sub-field 4SF having weight of 4 and a sub-field 5SF having weight of 4, as shown in FIG. 8B, the non-emitted sub-fields are added as sub-fields for the expression of gray scale. Then, using the arrangement of sub-fields as shown in FIG. 8B, all input picture signals within one frame can be expressed. Accordingly, the pseudo contour can be reduced as the weight difference between sub-fields having higher weights is decreased.

Figure 9A:
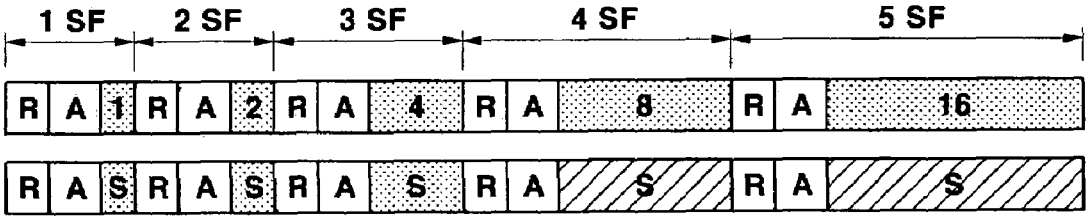
FIGS. 9A to 9C are diagrams illustrating the arrangement of sub-fields rearranged by the sub-field generator if the number of non-emitted sub-fields is 2.
Figure 9B:
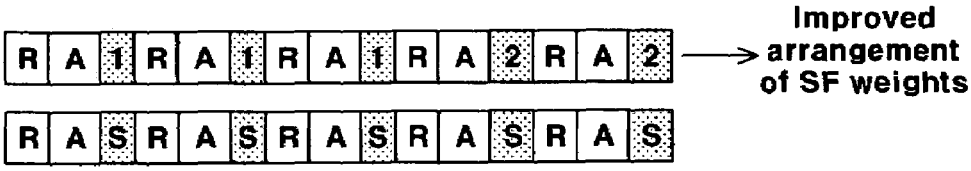
Figure 9C:
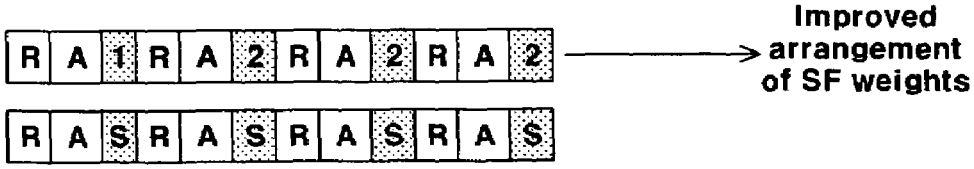

FIGS. 9A to 9C are diagrams illustrating the arrangement of sub-fields rearranged by the sub-field generator if the number of non-emitted sub-fields is 2. As before, 'R', 'A' and 'S' denote a reset portion, an address portion and a sustain portion', respectively.

FIG. 9A shows non-emitted sub-fields (sub-fields having weights of 16 and 8) when the level of gray scale of a maximum input picture signal is 4 to 7 in conventional arrangement of sub-fields. FIG. 9B shows the arrangement of sub-fields rearranged as sub-fields for reducing the pseudo contour by supplementing two sub-fields. FIG. 9C shows the arrangement of sub-fields rearranged as sub-fields for reducing the pseudo contour by supplementing one sub-field.

As shown in FIG. 9A, when the level of gray scale of a maximum input picture signal is 4 to 7, the sub-fields having weights of 8 and 16 are not emitted and not used to express the gray scale. Accordingly, sub-field generator 440 can rearrange the sub-fields by supplementing two sub-fields, as shown in FIG. 9B, so as to express the gray scale of the input picture signal data. In more detail, by dispersing sub-fields 2SF, 3SF having weights of 2 and 4 into sub-fields 2SF, 3SF having weight of 1 and sub-fields 4SF, 5SF having weight of 2, respectively, as shown in FIG. 9B, the non-emitted sub-fields are added as sub-fields for expression of gray scale.

In addition, sub-field generator 440 can rearrange the sub-fields by supplementing one sub-field, as shown in FIG. 9C, so as to express the gray scale of the input picture signal data. In more detail, by dispersing sub-field 3SF having weight of 4 into sub-fields 3SF, 4SF having weight of 2, as shown in FIG. 9C, the non-emitted sub-fields are added as sub-fields for expression of gray scale.

Then, using the arrangement of sub-fields as shown in FIGS. 9B and 9C, all input picture signals within one frame can be expressed. Accordingly, the pseudo contour can be reduced as the weight difference between sub-fields having higher weights is decreased.

When sub-field generator 440 receives the information of the number of non-emitted sub-fields from peak detector 430, it rearranges the sub-fields as shown in FIG. 8B (when the number of non-emitted sub-fields is 1) and FIG. 9B or 9C (when the number of non-emitted sub-fields is 2). In this case, it is apparent to those skilled in the art that the weights of the sub-fields in FIGS. 8B, 9B and 9C can be changed.

Referring to FIG. 6 again, APC 450 detects a load factor using picture data output from error diffuser 420, calculates an APC level based on the detected load factor, and calculates a weight multiple corresponding to the calculated APC level.

Sustain number generator 460 outputs the information of the number of sustains corresponding to the arrangement of sub-fields rearranged by using the weight multiple corresponding to the APC level calculated by APC 430 and the number of non-emitted sub-fields received from peak detector 430. In other words, sustain number generator 460 outputs the information of the number of sustains corresponding to weight of each sub-field in the arrangement of sub-fields as shown in FIG. 8B, 9B or 9C. The number of sustains is output to sustain and scan driving controller 480.

Sustain and scan driving controller 480 generates a control signal corresponding to the weight multiple output from sustain number generator 460 and outputs the control signal to sustain and scan driver 300. Although sustain number generator 460 and sustain and scan driving controller 480 are herein described as separate units, they can be implemented in a single unit.

Memory controller 470 rearranges data of sub-fields received from sub-field generator 440 into address data for driving the PDP. Also, memory controller 470 separates the address data for each sub-field within one frame and stores the separated address data in a frame memory (not shown in FIG. 6) for each sub-field. In addition, memory controller 470 reads the address data for all pixels for each sub-field from the frame memory and transmits the read address data to address driver 200.

As is apparent from the above description, the present invention provides a driving apparatus of a plasma display panel, which is capable of further reducing pseudo contour, which may be generated when a picture is displayed on the plasma display panel, by obtaining the number of non-emitted sub-fields and rearranging non-emitted sub-fields as sub-fields for reducing the pseudo contour based on the obtained number of non-emitted sub-fields.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims.

What is claimed is:

1. A driving apparatus of a plasma display panel, comprising:

a peak detector for determining at least one non-emitted sub-field in which no pixel is emitted using picture signal data having a maximum gray level among all input picture signal data within one frame and transmitting information of the at least one non-emitted sub-field;

a sub-field generator for dividing at least one sub-field having higher weight into a plurality of sub-fields having lower weights when the at least one non-emitted sub-field is determined by the peak detector; and a sustain number generator for generating a number of sustains corresponding to the plurality of sub-fields rearranged when the at least one non-emitted sub-field is determined by the peak detector.

2. The driving apparatus of claim 1, wherein information of the at least one non-emitted sub-field determined and transmitted by the peak detector is the number of the at least one non-emitted sub-field of all picture signal data within one frame.

3. The driving apparatus of claim 1, wherein weight differences between the plurality of sub-fields are gradually decreased as the weight becomes higher.

4. The driving apparatus of claim 2, wherein weight differences between the plurality of sub-fields are gradually decreased as the weight becomes higher.

5. The driving apparatus of claim 2, wherein the number of the plurality of sub-fields having lower weights is increased corresponding to the number of the at least one non-emitted sub-field determined by the peak detector.

6. The driving apparatus of claim 1, wherein data used to determine the at least one non-emitted sub-field by the peak detector is data for inverse gamma-correcting and error-diffusing the input picture signal.

7. The driving apparatus of claim 2, wherein data used to determine the at least one non-emitted sub-field by the peak detector is data for inverse gamma-correcting and error-diffusing the input picture signal.

8. The driving apparatus of claim 1, wherein the sustain number generator generates the number of sustains in consideration of weight multiple corresponding to an APC level calculated based on a load factor determined using the input picture signal data.

9. The driving apparatus of claim 2, wherein the sustain number generator generates the number of sustains in consideration of weight multiple corresponding to an APC level calculated based on a load factor determined using the input picture signal data.

10. The driving apparatus of claim 1, further comprising a frame memory for storing the input picture signal of one frame, the peak detector determining the at least one non-emitted sub-field using the input picture signal stored in the frame memory.

11. The driving apparatus of claim 2, further comprising a frame memory for storing the input picture signal of one frame, the peak detector determining the at least one non-emitted sub-field using the input picture stored in the frame memory.

12. A method for displaying a picture on a plasma display panel, the method comprising dividing a picture of each frame to be displayed on the plasma display panel into a plurality of sub-fields, corresponding to input picture signal data, and combining brightness weights of the plurality of sub-fields for expressing gray levels, the method comprising:

(a) determining at least one non-emitted sub-field in which no pixel is emitted using picture signal data having a maximum level of gray levels among all input picture signal data within one frame;

(b) dividing at least one sub-field having higher weight into a plurality of sub-fields having lower weights when the at least one non-emitted sub-field is determined in step (a); and (c) generating a number of sustains corresponding to the sub-fields rearranged when the at least one non-emitted sub-field is determined in step (a).

13. The method of claim 12, wherein information of the at least one non-emitted sub-field determined in step (a) is the number of the at least one non-emitted sub-field of all picture signal data within one frame.

14. The method of claim 12, wherein weight difference between the plurality of sub-fields in step (b) are gradually decreased as the weight becomes higher.

15. The method of claim 13, wherein weight difference between the plurality of sub-fields in step (b) are gradually decreased as the weight becomes higher.

16. The method of claim 13, wherein the number of the plurality of sub-fields having lower weights is increased corresponding to the number of the at least one non-emitted sub-field determined in step (a).

17. The method of claim 12, further comprising inverse gamma-correcting the input picture signal and error-diffusing errors caused by the inverse gamma correction throughout adjacent pixels before step (a).

18. The method of claim 13, further comprising inverse gamma-correcting the input picture signal and error-diffusing errors caused by the inverse gamma correction throughout adjacent pixels before step (a).

* * * * *